US008911301B1

(12) United States Patent
Allen

(10) Patent No.: US 8,911,301 B1
(45) Date of Patent: Dec. 16, 2014

(54) GOLF IRON FACETONGUE

(71) Applicant: Dillis V. Allen, Schaumburg, IL (US)

(72) Inventor: Dillis V. Allen, Schaumburg, IL (US)

( * ) Notice: Subject to any disclaimer, the term of this patent is extended or adjusted under 35 U.S.C. 154(b) by 39 days.

(21) Appl. No.: 13/741,500

(22) Filed: Jan. 15, 2013

(51) Int. Cl.
*A63B 53/04* (2006.01)

(52) U.S. Cl.
CPC ..... *A63B 53/047* (2013.01)
USPC ..... 473/329; 473/332; 473/333; 473/342; 473/350

(58) Field of Classification Search
CPC ..... A63B 53/04; A63B 53/08; A63B 2053/0495; A63B 53/0475; A63B 53/047
USPC ..... 473/324–350, 287–292, 219–256
See application file for complete search history.

(56) References Cited

U.S. PATENT DOCUMENTS

| | | | | |
|---|---|---|---|---|
| 819,900 | A * | 5/1906 | Martin | 473/329 |
| 4,170,357 | A * | 10/1979 | Greer | 473/333 |
| 5,398,929 | A * | 3/1995 | Kitaichi | 473/329 |
| 5,403,007 | A * | 4/1995 | Chen | 473/342 |
| 5,505,453 | A * | 4/1996 | Mack | 473/329 |
| 5,873,791 | A * | 2/1999 | Allen | 473/309 |
| 6,015,354 | A * | 1/2000 | Ahn et al. | 473/256 |
| 6,354,956 | B1 * | 3/2002 | Doong | 473/219 |
| 6,743,117 | B2 * | 6/2004 | Gilbert | 473/332 |
| 7,083,531 | B2 * | 8/2006 | Aguinaldo et al. | 473/350 |
| 7,131,913 | B2 * | 11/2006 | Iwata et al. | 473/350 |
| 7,261,642 | B2 * | 8/2007 | Blankenship | 473/326 |
| 7,288,030 | B2 * | 10/2007 | Blankenship | 473/326 |
| 7,582,024 | B2 * | 9/2009 | Shear | 473/329 |
| 7,651,408 | B2 * | 1/2010 | Hagood et al. | 473/329 |
| 7,708,653 | B2 * | 5/2010 | Hawkins et al. | 473/329 |
| 7,731,602 | B2 * | 6/2010 | Cage | 473/324 |
| 7,988,567 | B2 * | 8/2011 | Kim et al. | 473/329 |
| 2007/0026961 | A1 * | 2/2007 | Hou | 473/329 |
| 2013/0331201 | A1 * | 12/2013 | Wahl et al. | 473/329 |

OTHER PUBLICATIONS

Exhibit A—public web page dated Nov. 7, 2012.
Taylormade RocketBladez irons.

* cited by examiner

*Primary Examiner* — Sebastiano Passaniti
(74) *Attorney, Agent, or Firm* — Dillis V. Allen, Esq.

(57) ABSTRACT

A golf iron clubhead configuration tor increasing and controlling face flexure while stabilizing the face in all directions other than the flexure direction and reducing face vibration. The two features that contribute to these results are firstly to free the facewall from z axis restraint by the other portions of the clubhead to the maximum extent possible, limited by clubhead integrity. The second is to stabilize the free face in x and y coordinates of the facial plane with a horizontally elongated tongue or piston attached indirectly, not directly to the face. This tongue slides and is stabilized in a tight-fitting lubricated groove in the rear of the clubhead positioned downwardly from the geometric center of the clubface.

19 Claims, 3 Drawing Sheets

GOLF IRON FACETONGUE

BACKGROUND OF THE INVENTION

Club designers, including myself, have worked indefatigably over the last 20 years to improve golf ball distance travel by using various techniques to increase the spring effect of the clubhead facewall as it impacts the ball for a relatively few milliseconds. Contact between the clubface and ball occurs usually over only a distance of less than about 0.5 inches, even with driver type clubs.

Once considered illegal by the mercurial governing golf body, the United States Golf Association (USGA), such spring-like effect is now considered within the USGA Rules, as well as the Rules of the European R & A (Royal and Ancient) body.

Designers have approached these objectives in a variety of ways. One successful approach has been the thinning of the facewall around its perimeter so it flexes more where the facewall joins the crown wall, the toe wall, the heel wall and the sole wall. Another technique employed by Adams Golf, for example, is to form a slot in the sole wall just to the rear of the facewall and parallel thereto. Another similar technique is incorporated into the Taylormade Rocketbladez irons.

A third design, shown in the Blankenship, U.S. Pat. No. 7,288,030, assigned to Karsten Manufacturing Co., never adopted in any commercial club, shows two pistons attached to the rear surface that are dampened by a magnetic fluid in the piston chambers.

The problem in all these designs is that they do not satisfy the necessary face flexure criteria set forth in the abstract. That is, none of these designs frees the facewall to the maximum extent possible and hence have only limited face flexure.

It is a primary object of the present invention to ameliorate the above problems in the prior art.

SUMMARY OF THE PRESENT INVENTION

In accordance with the present invention, a golf iron clubhead configuration is provided for increasing and controlling face flexure while stabilizing the face in all directions other than the flexure direction and reducing face vibration. The two features that contribute to these results are firstly to free the facewall from z axis restraint by the other portions of the clubhead to the maximum extent possible, limited by clubhead integrity. The second is to stabilize the free face in x and y coordinates of the facial plane with a horizontally elongated tongue or piston attached indirectly, not directly, to the face. This tongue slides and is stabilized in a tight fitting lubricated groove in the rear of the clubhead positioned downwardly from the geometric center of the clubface.

Facewall freedom is affected by a "U" shaped channel just behind and running along the entire length of the lower edge of the facewall. The rear leg of this channel extends vertically upwardly behind and parallel to the facewall. The upper edge of the rear leg has unrestricted movement fore and aft along the clubhead target line, which distinguishes this technique. Also, the wall extends significantly into both the toe and the heel of the clubhead to increase face flexure.

An arcuate horizontally elongated tongue is formed on the rear surface of the rear leg that slides in a complementary groove or cylinder in the rear of the clubhead. The tongue is dampened in x and y directions and fitted to the groove with a PTFE ring and the groove is lubricated with pure silicone oil injected through an Alemite flush-mount fitting in the rear of the clubhead. The elongated tongue and cylinder configuration therein stabilizes the face in x-y directions across the face of the clubface (x and y designations refer to orthogonal coordinates on the facewall in the plane of the facewall, the z axis falling perpendicular to the facewall at the geometric center of the facewall).

It should be understood that piston oriented or incorporating clubheads have been commonplace in the prior art to reinforce clubfaces. In fact, in my own U.S. Pat. No. 5,873,791 issued Feb. 23, 1999, I disclose a piston reinforced face clubhead that won $6^{th}$ place in the Long Drive National Championship in Las Vegas in 1996. And the Blankenship, U.S. Pat. No. 7,288,030, assigned to Karsten Manufacturing Corporation, shows a piston also connected to the clubface. However, all of these piston devices are connected directly to the rear of the clubface and thus reinforce the face rather than freeing the face for maximum flexure. The present invention solves this problem by isolating the piston or tongue from the rear of the clubface, utilizing only the perimeter of the clubface as the point of attachment.

It should also be understood that the specific embodiment of the prevent invention is incorporated into iron-type golf clubs because the metal thickness behind the facewall provides increased opportunity to house the presently designed tongue and groove. However, it may be that some future visionary may well adopt these principles into a metal wood-type club so that possibility is within the scope of the present invention and that the term "iron" in the Claims is intended to be only preferable and not limiting.

Other objects and advantages will appear more clearly from the following detailed description.

DETAILED DESCRIPTION OF THE PREFERRED EMBODIMENTS

Figure 1:
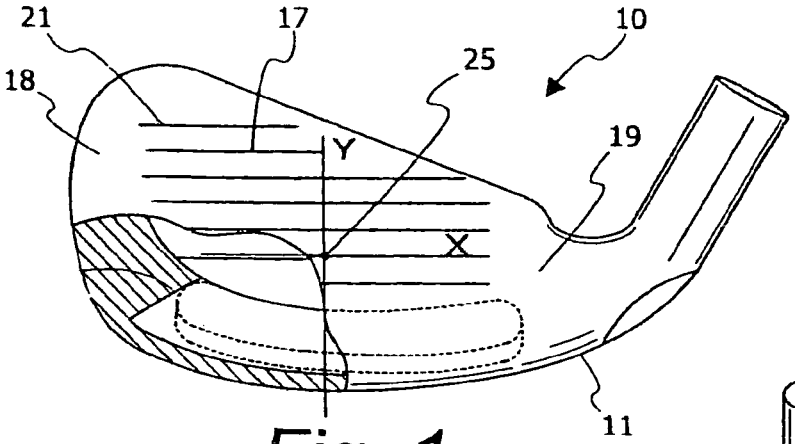
FIG. 1 is a front view of an iron clubhead with the present golf iron facetongue broken away at the toe to show part of the tongue.
Figure 2:
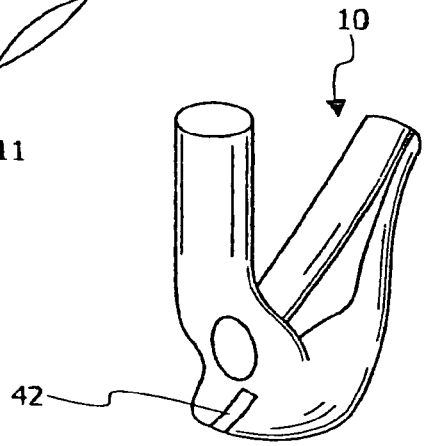
FIG. 2 is a right side view of an iron clubhead with the present golf iron facetongue shown in FIG. 1, showing the heel portion of the tongue slot.

Referring to the drawings and particularly FIGS. 1 to 4, the present golf iron clubhead is depicted generally by the reference numeral 10 and incorporates the golf iron facetongue technology of the present invention. As seen in these figures, the iron clubhead 10 is seen to include a clubhead body 11 with a toe portion 12 and a heel portion 13 with a hosel 16 extending upwardly from the heel portion 13 and a generally planar facewall 17 having a toe portion 18 and a heel portion 19 and generally parallel horizontal grooves 21.

Figure 4:
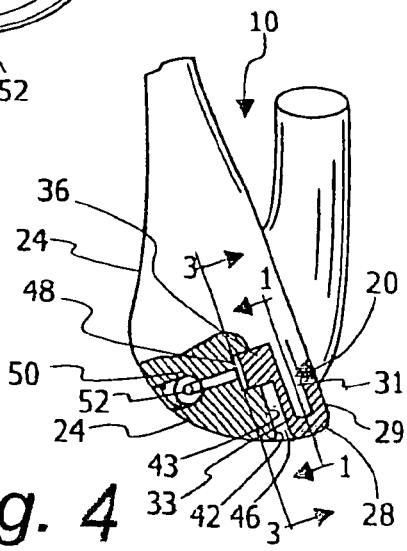
FIG. 4 is a left side view of an iron clubhead with the present golf iron facetongue shown in FIG. 1, with the toe broken away to show the tongue, cylinder, and lubrication system.
Figure 5:
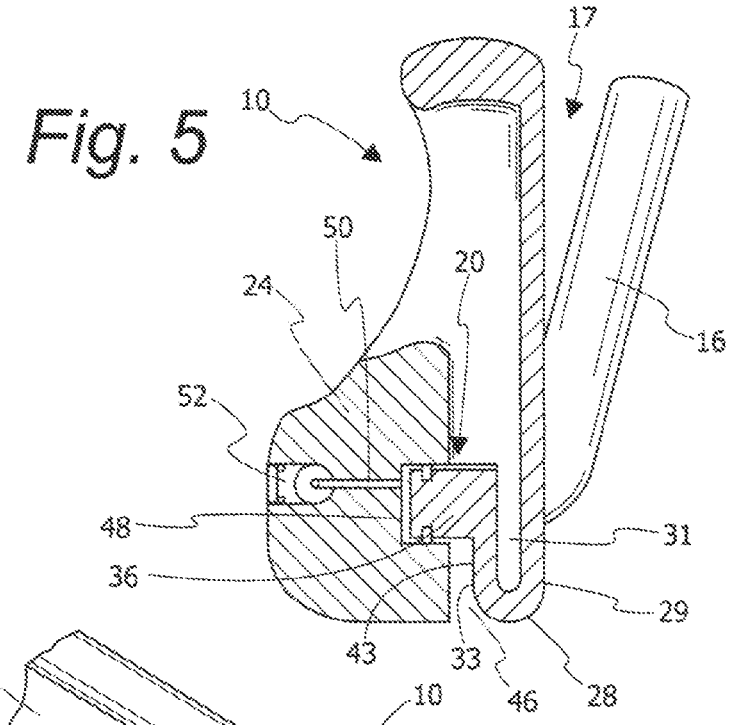
FIG. 5 is an enlarged view of an iron clubhead with the present golf iron facetongue shown in FIG. 1, taken generally along line 5-5 of FIG. 3.

As seen clearly in part cross section in FIG. 4, the present invention includes a tongue and groove assembly 20 that acts to free the facewall 17 for maximum flexation because it is connected only to the extreme bottom of facewall 17, and at the same time stabilizes the facewall 17 in the x and y coordinates lying in the facewall as depicted in FIG. 1 about the geometric center 25 of the facewall.

The tongue and groove assembly 20 includes an extreme lower portion of facewall 17 designated 29 in FIG. 4 included in a U-shaped flange 28 that includes an upwardly extending wall 33, arcuate tongue 36 and arcuate portion complementary cylinder or groove 42, extending parallel to the clubface 17 in rear portion 24 of the clubhead 10.

Figure 3:
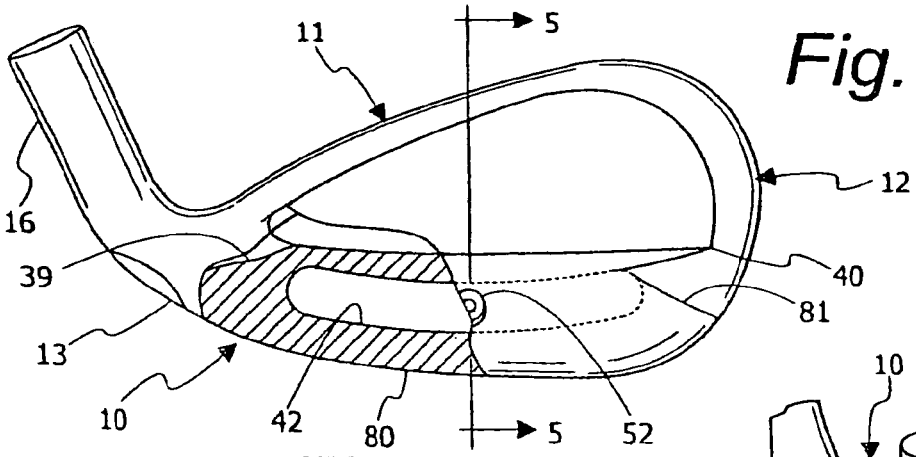
FIG. 3 is a rear view of an iron clubhead with the present golf iron facetongue shown in FIG. 1, broken away at the heel illustrating the clubhead body tongue cavity.

Slot 31 (the first slot), defined by U-shaped flange 28, behind the clubface 17 extends toward the toe all the way to point 40 indicated in FIG. 3, and also extends to point 39 in FIG. 3 at the heel portion 13 of the clubhead to maximize the freedom of flexation of clubface 17.

The slot 46 (the second slot), between the wall 33 and rear clubhead portion 24 is approximately at 0.075 inch, and extends from diagonal line 81 at the toe and diagonal line 39 at the heel.

The tongue portion 36 is arcuate in configuration approximately complementing the curvature of the lower edge 80 of the clubhead body 11 and is struck about a radius of approximately 8.5 inches extending through and above geometric center 25 of clubface 17 along y axis in FIG. 1, lying in a vertical plane along the target line. This is an important aspect of the present invention to promote face stabilization.

The fundamental purpose of the tongue and groove assembly 20 is to stabilize the clubface about the x and y coordinates illustrated in FIG. 1, and is not to inhibit in any way the flexure of the clubface 17 along its z axis.

It should be noted that the groove 31 between wall portion 29 and wall 33 is approximately 0.080 inch in width, while groove 46 between wall 33 and wall 43 is rearward body portion 24 is approximately 0.075 inch.

The chamber 48 at the rear of cylinder 42 between the end of tongue 36 and the rearward body portion 24 is lubricated by a passage 50 extending perpendicular to face 17 through body portion 24 and is fed lubricant through an Alemite-type flush mount fitting 52 mounted in rear surface 54 of rearward body portion 24. Alemite fitting 52 is essentially a check valve that prevents the outflow of lubricant from passage 50, and chamber 48 after lubricant is dispensed through fitting 52 by a conventional small dose hand-lever actuated cartridge pump commercially available.

It should be understood that the dumber 48 operates at ambient pressure and the viscosity in the chamber 48 is not altered by the addition of lubricant through fitting 52, which is a very low viscosity 100 percent silicone thin film lubricant, which is almost water-like in viscosity and that the pressure of fluid or air in chamber 48 has no effect on the movement of piston 36 in groove 42.

Figure 6:
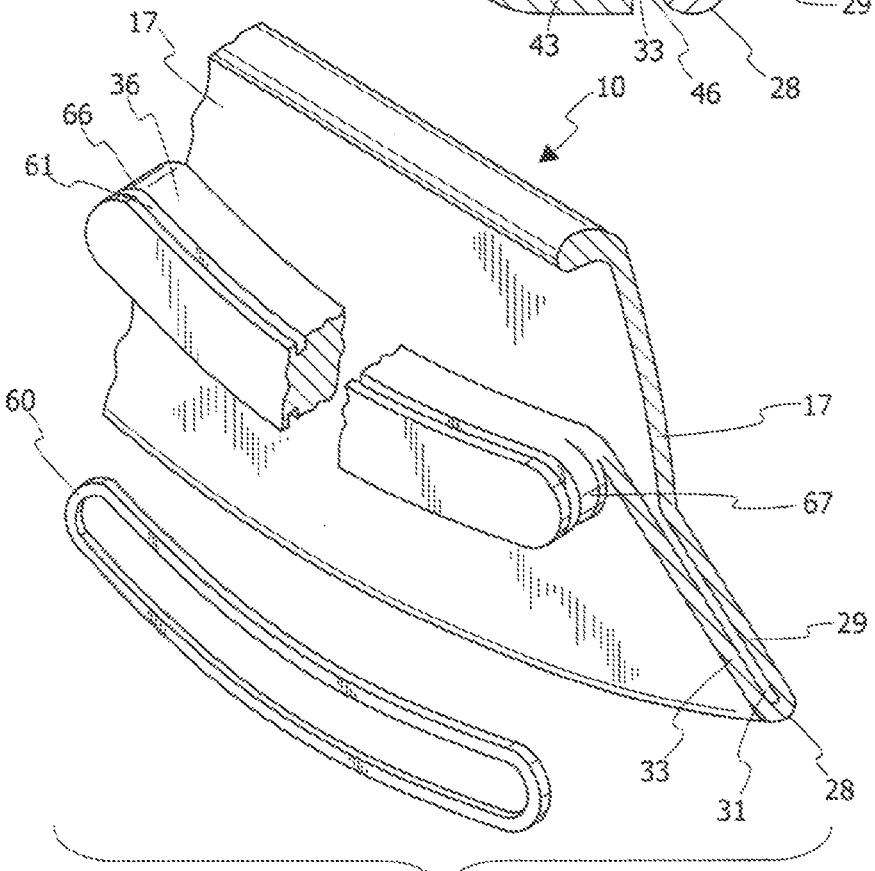
FIG. 6 is an enlarged perspective of the control section of the iron clubhead with the present golf iron facetongue as shown in FIG. 1, partly exploded.

As seen in FIG. 6, a polytetrafluoroethelene (PTFE) ring 60 seats in a rectangular peripheral groove 61 extending completely around tongue 36 for the purpose of sealing the tongue 36 in the groove 42 and for preventing the escape of lubricant from chamber 48, and at the same time acting as a vibration dampening element solely in the x and y coordinates illustrated in FIG. 1 to stabilize the facewall 17 during impact of the golf club on the forward surface of the facewall 17.

The extension of groove 46 to angular line 40 at the toe of the club and to angular line 39 at the heel club increases the flexibility of not only the facewall 17 but also the upwardly extending wall 33 to maximize clubface flexure.

The arcuate tongue portion 36 slides in the closely fitted complementary arcuate groove 42 in the rear portion of the clubhead with a clearance of only about 0.010 inch.

It is an important aspect of the present invention that the tongue portion 36 is not only arcuate in configuration and has a radius of approximately 8.5 inches, but also that the groove 42, as well as the tongue 36, extend substantial distances on the toe and heel side of the geometric center of the face approximately a distance of 0.750 to 1.00 inch, and substantially below the geometric center, although the exact extent of toe and heel extension of the tongue 36 and groove can be more precisely determined by further experimentation.

As seen in FIG. 6, tongue 36 has a fore to aft depth of approximately 0.190 inch.

The tongue portion 36 also has a vertical height of about 0.190 inch and the arcuate groove 42 has a vertical height of about 0.210 inch. Furthermore, the ends of the tongue 36 and groove 42 are semi-circular in configuration and consists of heel end 66 and toe end 67 having arcuate surfaces equal in diameter to the thickness of the tongue 36 and groove 42 respectively.

Figure 7:
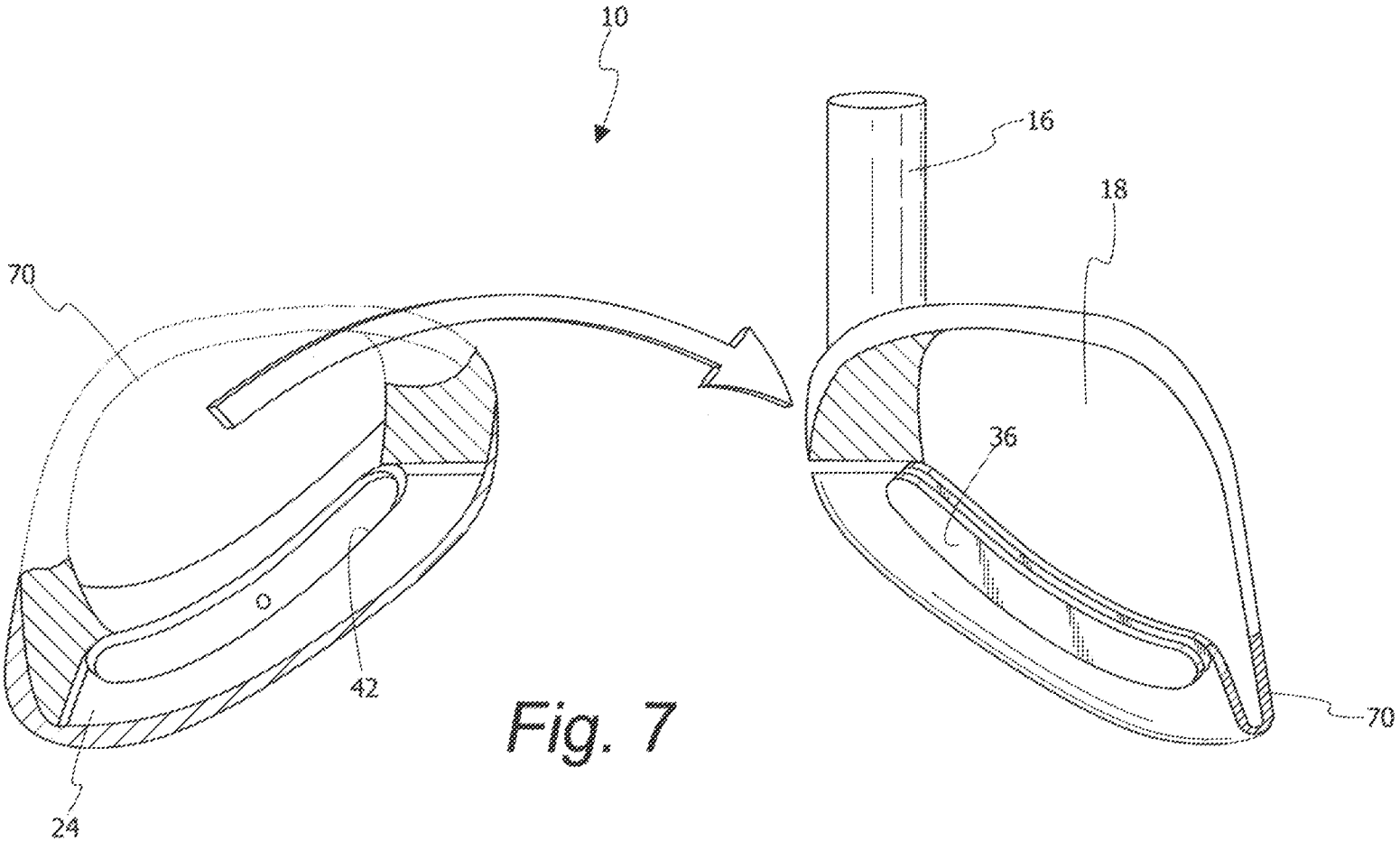
FIG. 7 is an exploded view of an iron clubhead with the present golf iron facetongue as shown in FIG. 1, with the front of the clubhead separated from the rear at approximately the toe and heel of the clubhead.

Referring to FIG. 7, it should be understood that rear portion 24, at the left of FIG. 7, is broken away from forward portion 70 of clubhead 10 to illustrate the groove 42 and the tongue portion 36 and that the drawing is meant to depict the rear and forward halves of the club in the rotationally exploded form to illustrate how they collapse and attach together by welding or fasteners.

It should also be understood that in manufacture that the forward portion of the club 70 and the rear portion of the club 24 could be molded or cast, or investment cast in separate pieces and that the two welded and fastened together, after casting. In this regard, in the left half of FIG. 7, the forward portion of the clubhead 70 is depicted in dotted lines and does not mean that that is included in the rear portion 24, which is attached to the forward portion 70 and that is only shown in FIG. 7 to illustrate the relative positioning of the rear portion 24 with respect to the forward portion 70 on the left side of the view.

The invention claimed is:

1. An iron golf clubhead, comprising: a clubhead body having a facewall with a lower portion, a toe portion, a heel portion, and a rearwardly extending portion, a hosel extending generally upwardly from the heel portion, a wall portion extending rearwardly and integrally upwardly from the lower portion of the facewall, and a tongue defined at least in part by and integral with the upwardly extending wall portion unconnected to the body rearwardly extending portion so it is free to flex forwardly and rearwardly relative to the rearwardly extending portion.

2. An iron golf clubhead as defined in claim 1, wherein the tongue has a portion extending rearwardly from the upwardly extending wall portion and the rearwardly extending portion has a cylinder complementary in shape to the tongue in the wall portion and facing forwardly.

3. An iron golf clubhead as defined in claim 2, including a lubrication system for the cylinder in the rearwardly projecting portion.

4. An iron golf clubhead as defined in claim 2, wherein the tongue is arcuate with its lowest point near the target line on the clubhead.

5. An iron golf clubhead as defined in claim 2, wherein the tongue is generally symmetrical about the geometric center of the clubface.

6. An iron golf clubhead as defined in claim 2, including a seal groove around the tongue and a seal ring encompassing the groove.

7. An iron golf clubhead, as defined in claim 1 including said facewall having a periphery, said facewall having at least a portion of the facewall free to move in a direction perpendicular to the facewall.

8. An iron golf clubhead as defined in claim 7, including a horizontally elongated tongue portion projecting rearwardly from the wall portion slidable in the rearwardly extending portion.

9. An iron golf clubhead as defined in claim 8, wherein the rearwardly extending portion has a cylinder or groove complementary in shape to the elongated tongue portion on the wall portion and facing forwardly.

10. An iron golf clubhead as defined in claim 8, including a seal groove around the tongue portion and a seal ring encompassing the groove.

11. An iron golf clubhead as defined in claim 1, said facewall having said lower portion thereof free to move along a target line relative to other portions of the clubhead, and a horizontally extending and moveable stabilizer for the clubface connected to said lower portion of the facewall.

12. An iron golf clubhead as defined in claim 11, wherein said stabilizer includes a horizontally elongated tongue portion projecting rearwardly from the wall portion slidable in the rearwardly extending portion.

13. An iron golf clubhead as defined in claim 1, and a horizontally extending and moveable stabilizer for the clubface connected to said lower portion of the facewall wherein said stabilizer includes a horizontally elongated tongue portion projecting rearwardly from the wall portion slidable in the rearwardly extending portion wherein the tongue portion is arcuate with its lowest point near the target line on the clubhead, the tongue portion being generally symmetrical about the geometric center of the clubface, and including a seal groove around the tongue portion and a seal ring encompassing the groove.

14. An iron golf clubhead including a clubhead body having a facewall with a toe portion, a heel portion, and a rearwardly extending portion, a hosel extending generally upwardly from the heel portion, said facewall having a periphery, said facewall having at least a portion of the facewall free to move in a direction perpendicular to the facewall, and a tongue and groove device connected to the free portion of the facewall to stabilize the facewall, including a wall portion extending upwardly and integrally from the lower portion of the facewall, and a horizontally elongated tongue projecting rearwardly from the wall portion slidable in the rearwardly extending portion wherein the rearwardly extending portion has a cylinder or groove complementary in shape to the elongated tongue on the wall portion and facing forwardly, including a lubrication system for the cylinder in the rearwardly projecting portion.

15. An iron golf clubhead including a clubhead body having a facewall with a toe portion, a heel portion, and a rearwardly extending portion, a hosel extending generally upwardly from the heel portion, said facewall having a periphery, said facewall having at least a portion of the facewall free to move in a direction perpendicular to the facewall, and a tongue and groove device connected to the free portion of the facewall to stabilize the facewall, including a wall portion extending upwardly and integrally from a lower portion of the facewall, and a horizontally elongated tongue projecting rearwardly from the wall portion slidable in the rearwardly extending portion, wherein the tongue is arcuate with its lowest point near the target line on the clubhead.

16. An iron golf clubhead including a clubhead body having a facewall with a toe portion, a heel portion, and a rearwardly extending portion, a hosel extending generally upwardly from the heel portion, said facewall having a periphery, said facewall having at least a portion of the facewall free to move in a direction perpendicular to the facewall, and a tongue and groove device connected to the free portion of the facewall to stabilize the facewall, including a wall portion extending upwardly and integrally from a lower portion of the facewall, and a horizontally elongated tongue projecting rearwardly from the wall portion slidable in the rearwardly extending portion, wherein the tongue is generally symmetrical about the geometric center of the clubface.

17. An iron golf clubhead, comprising: a clubhead body having a facewall with a toe portion, a heel portion, and a rearwardly extending portion, a hosel extending generally upwardly from the heel portion, said facewall having a lower portion thereof free to move along a target line relative to other portions of the clubhead, said facewall having a lower sole portion with an integral "U" shaped flange defined in a plane perpendicular to a club head target line with an arcuate sole portion and an upwardly extending wall portion behind the facewall, said "U" shaped flange defining a first slot between the facewall and the upwardly extending wall portion and a second slot between the upwardly extending wall portion and the rearwardly extending portion of the clubhead body, said upwardly extending wall portion defining an upwardly extending tongue that is unconnected to the rearwardly extending portion of the clubhead over most of the length of the "U" shaped flange so it is free to move relative to the rearwardly extending portion in a direction parallel to the clubhead target line and perpendicular to the facewall.

18. An iron golf clubhead as defined in claim 17, wherein the tongue has a portion extending rearwardly from the upwardly extending wall portion and the rearwardly extending portion has a cylinder complementary in shape to the tongue in the wall portion and facing forwardly.

19. An iron golf clubhead as defined in claim 18, wherein the tongue is arcuate with its lowest point near the target line on the clubhead.

* * * * *